United States Patent [19]

Arbor

[11] Patent Number: 4,895,377

[45] Date of Patent: Jan. 23, 1990

[54] JUGGLING STICKS

[76] Inventor: Arbor, 1907 Delaware Ave., Santa Cruz, Calif. 95060

[21] Appl. No.: 149,844

[22] Filed: Jan. 29, 1988

[51] Int. Cl.[4] ..... A63B 67/00

[52] U.S. Cl. ..... 273/327; 273/428; 446/240

[58] Field of Search ..... 446/240, 266, 255, 236, 446/242; 273/318, 340, 1 G, 327, 428; 272/93, 124

[56] References Cited

U.S. PATENT DOCUMENTS

| | | | |
|---|---|---|---|
| 2,364,137 | 12/1944 | Gibb | 273/428 |
| 2,377,498 | 6/1945 | Jacke | 273/428 |
| 3,008,264 | 11/1961 | Rutherford | 446/236 |
| 3,106,039 | 10/1963 | Simpson | 273/327 X |
| 3,382,605 | 5/1968 | Compton | 446/240 |
| 3,443,809 | 5/1969 | Montanez | 273/428 X |
| 3,528,659 | 9/1970 | Benham | 273/428 X |
| 4,117,625 | 10/1978 | O'Neil | 446/266 |
| 4,118,030 | 10/1978 | Randon | 446/240 X |
| 4,232,473 | 11/1980 | Jenkins | 446/119 X |
| 4,682,774 | 7/1987 | Holy | 273/67 R X |
| 4,750,745 | 6/1988 | Benham | 446/485 X |
| 4,796,883 | 1/1989 | Ratner | 273/318 X |

OTHER PUBLICATIONS

Peer "Twirl-aton", Plaything, Sep. 1959, p. 83.

*Primary Examiner*—Mickey Yu

*Attorney, Agent, or Firm*—Limbach, Limbach & Sutton

[57] ABSTRACT

A juggling stick is disclosed having an inward facing conical shaped ferrule, positioned at each end of a central rod. Positioned along the rod is a pair of outward facing conical shaped ferrules.

9 Claims, 3 Drawing Sheets

JUGGLING STICKS

FIELD OF THE INVENTION

This invention relates to the field of aero toys. More particularly, this invention relates to a juggling stick for play off a secondary spinner stick.

BACKGROUND OF THE INVENTION

Juggling and other games of manual dexterity have been popular diversions among fun loving persons. Juggling sticks that have a central rod are known. A secondary hand-held stick is used to upwardly strike the juggling stick. The goal of the game is to keep the stick in the air by striking it with the secondary stick. In order to enhance the ease of promoting continued play inwardly bent hooks on the central rod have been utilized as described in U.S. Pat. No. 3,106,039 and inwardly cambered end-caps as described in U.S. Pat. No. 3,528,659.

The play using such a juggling stick having cambers or hooks only at the distal ends of the juggling stick is difficult to continue and therefore frustrating for the player. For example, if the juggling stick is falling without rotation at a canted angle going down from left to right and the secondary stick were to hit the juggling stick near the upper left hand end, the secondary stick would easily catch the hook or inwardly cambered end-cap to allow the player to easily toss the juggling stick upward to keep the game in play. On the other hand, should the player strike the same falling stick near the right hand end, in order to make a play, he must either allow the juggling stick to slide across the secondary stick to the upper end in order to catch the upper left hand end of the juggling stick, an extremely difficult play, or allow the upper left hand end to fall below the right hand end held in place by the secondary stick in order to make a play. By allowing the upper left hand end to fall below the right hand end in order to capture the inwardly cambered end-cap of the right hand end, extreme rotational velocity is imparted to the juggling stick making subsequent play extremely difficult. Thus, an improved juggling stick is needed to make play easier and more fun.

SUMMARY OF THE INVENTION

An improved juggling stick is disclosed which has a central shaft. The juggling stick has a pair of opposing inwardly conical frustum ferrules positioned at each distal end of the juggling stick. The juggling stick also has a pair of conical frustum ferrules outwardly facing with respect to one another positioned at or near the center of the juggling stick.

DETAILED DESCRIPTION OF THE PREFERRED EMBODIMENT

Figure 1:
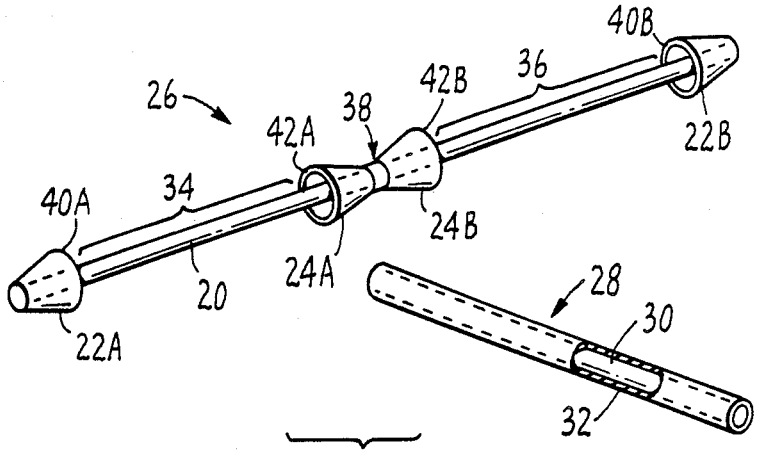
FIG. 1 shows a juggling stick and a spinner stick.

FIG. 1 shows the preferred embodiment of the present invention. The juggling stick has a central rod 20. The central rod is formed of a tube 23½ inches in length, ½ inch in diameter and a wall 1/16 inch thick. In order to enhance the visual effect of the game, the central rod 20 may be painted or decorated as deemed suitable. The central rod 20 may be formed of wood or may be a hollow tube of pvc (poly vinyl chloride), fiberglass or the like. Positioned at each end is an inwardly facing conical frustum shaped ferrule 22*a* or 22*b*. The ferrules may also have a variety of curved or cambered shapes. The ferrules may be formed of leather, rubber or vinyl. The ferrules are preferably firm so as not to deform on striking, but pliable to act as a shock absorber. Positioned to extend outwardly from near the center of the rod 20 is a pair of outwardly facing conical shaped ferrules 24*a* and 24*b*. This entire assembly is the juggling stick 26. The rod 20 and ferrules 22*a*, 22*b*, 24*a* and 24*b* may all be formed simultaneously with a blow molding process to form a lightweight version weighing 2½ to 4 ounces. The blow molded juggling stick may have a ribbed or roughened surface to increase friction. The juggling stick may also be manufactured using an injection molding process. The inventor has coined the term "Haikichi Stick" to describe the juggling stick of the present invention.

The spinner stick 28 is a hand-held rod used to strike, catch and throw the juggling stick 26. The spinner stick 28 is preferably a ⅜ inch wooden dowel or other similar elongated member 30 surrounded by a soft, high friction 3/16 inch thick latex or rubber coating 32. The coating 32 allows for better action and control of the juggling stick 26.

The spinner stick may be wrapped in tape rather than the latex coating 32. Further, for additional safety the ends of the spinner sticks may be dipped in a liquid rubber or plastic and allowed to cure. This will help to prevent injury due to the dowell becoming exposed during play.

There are seven primary striking surfaces on the juggling stick 26. The player will elect to use one of these seven surfaces depending upon the attitude of the juggling stick immediately prior to striking or catching the stick in preparation for the next toss or hit.

The first three striking surfaces are each a portion of the rod 20. The first striking surface 34 is that portion of the rod 20 between the end ferrule 22*a* and central ferrule 24*a*. The next striking surface 36 is that portion of the rod 20 between the end ferrule 22*b* and the central ferrule 24*b*. The third striking surface 38 is that portion of the rod 20 in or near the center between the two central ferrules 24*a* and 24*b*. Striking surface 38 may be covered with a portion of the material from which the central ferrules 24*a* and 24*b* are formed.

The other four striking surfaces are formed by the larger open ends of the ferrules. Thus, the striking surface 40*a* is the surface of the larger end of the ferrule 22*a*. Another striking surface 40*b* is the surface of the larger end of the ferrule 22*b*. The striking surface 42*a* is the surface of the larger end of the outward facing central ferrule 24*a*. The striking surface 42*b* is the surface of the larger end of the outward facing central ferrule 24*b*.

Figure 2:
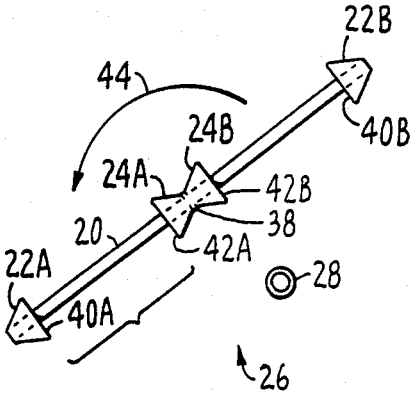
FIGS. 2 through 4 show the juggling stick and spinner stick in a variety of common attitudes and rotational velocities during normal play circumstances.

While playing with the juggling stick, it is possible that the player may wish to strike the stick when it is in the attitude shown in FIG. 2. If the juggling stick is rotating as shown by the arrow 44 in FIG. 2 at the precise moment when the player wishes to strike the juggling stick, the player is likely to not try to strike the striking surfaces 40*a* or 42*b* as such a play would drive the juggling stick 26 downward into the ground. Striking the striking surface 40*b* will enhance the rotational velocity of the juggling stick making subsequent play increasingly difficult. Without the central ferrules 24*a* and 24*b*, an attempt to strike the end of the juggling stick 34 may stop the rotational velocity of the juggling stick 26 or it may cause the juggling stick 26 to bounce away or slide uncontrollably down the spinner stick 28 or away from the player. In such a circumstance, hitting striking surface 42*a* will slow or stop the rotational velocity 44 of the juggling stick 26 and affords a good striking surface for making the play.

Figure 3:
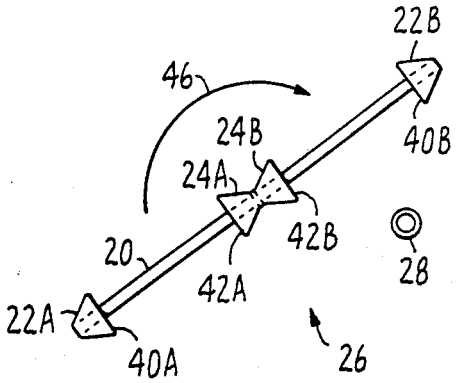

In FIG. 3, the juggling stick 26 is shown in a similar attitude to that shown in FIG. 2. However, the rotational velocity 46 is shown in the opposite direction of that of FIG. 2. In this circumstance, striking the striking surface 42*a* which is preferable in FIG. 2 for a juggling stick in the same attitude, but with opposite rotation, would further enhance the rotational velocity 46 of the juggling stick 26 making subsequent play more difficult. Hitting striking surface 40*b* will slow down the rotational velocity 46 allowing continued easy play.

Figure 4:
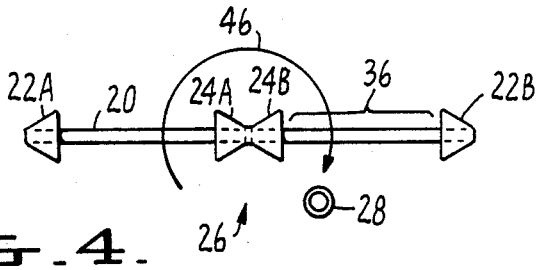

In FIG. 4, if the player waits a moment before striking the juggling stick 26 from the attitude and position shown in FIG. 3, the juggling stick will approach and perhaps pass through a horizontal position as shown in FIG. 4. At the time juggling stick is horizontal, the player will likely strike the juggling stick 26 with the spinner stick 28 on the rod 20 in the striking surface 36. Depending on the magnitude of the rotational velocity 46, the player may strike the surface 36 closer to the end ferrule 40*b* or the central ferrule 42*b*. Each of these plays will impart a different rotational effect to the juggling stick 26.

Figure 5:
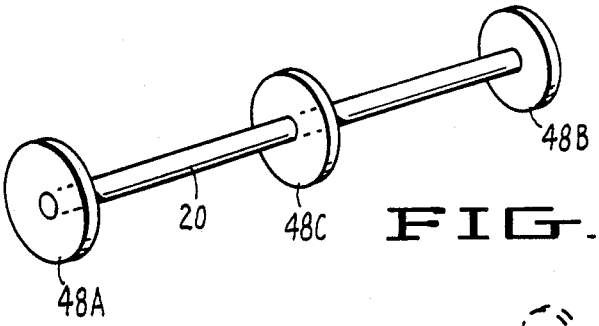
FIG. 5 shows a first alternate embodiment of the present invention.

FIG. 5 shows a first alternate structure of the preferred embodiment. In FIG. 5, the end ferrules 22*a* and 22*b* are each replaced with a disc 48*a* and 48*b* respectively. The pair of central outwardly facing ferrules 42*a* and 42*b* are replaced with a central disc 48*c*. The pair of central outwardly facing ferrules 42*a* and 42*b* may also be replace with a pair of space apart discs 48*c*.

It may be desirable when practicing the present invention to utilize several pairs of ferrules 24*a* and 24*b* or more than one disc 38*c*. The important feature in using multiple central striking surface such as these pairs of ferrules or discs is that the rod 20 be of sufficient length to allow easy access to the striking surfaces by the spinner stick.

Figure 6:
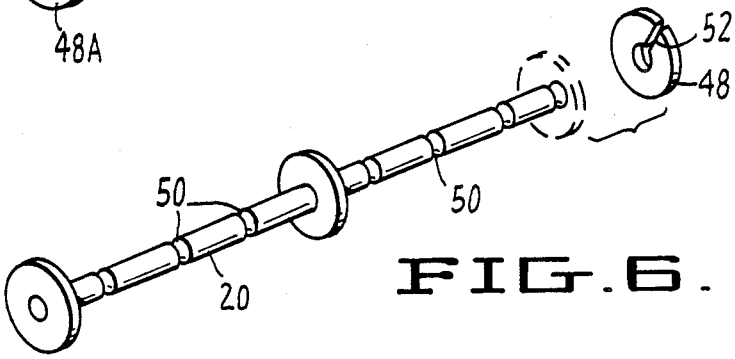
FIG. 6 shows a second alternate embodiment of the present invention.

A second alternate embodiment of the present invention is shown in FIG. 6. In this embodiment there are a plurality of circular notches 50 formed into the circumference of the rod 20 at spaced apart intervals along the length of the rod 20. Pairs of ferrules 24 or discs 48 are positioned along the rod 20 and caused to remain in any one of the notches 50. Such a practice allows for changes to be made to the balance and weight of the juggling stick 26 for beginning and advanced players. The discs 48 may be made of a sufficiently pliable material, such as latex, to be slid along the rod 20 from notch 50 to notch 50. Alternatively, the discs 48 may have a slot 52 formed into them radially to allow the disc 48 to be placed onto a particular notch 50. Such a disc 48 must be sufficiently pliable to allow the disc 48 to be deformed for placement onto the rod 20 and sufficiently rigid to remain in place. With such an embodiment, the stick can be made heavier or lighter by using different numbers of discs. The stick can also be made to spin slower or faster as a function of the position of the central ferrules relative to the center of the juggling stick.

Figure 7:
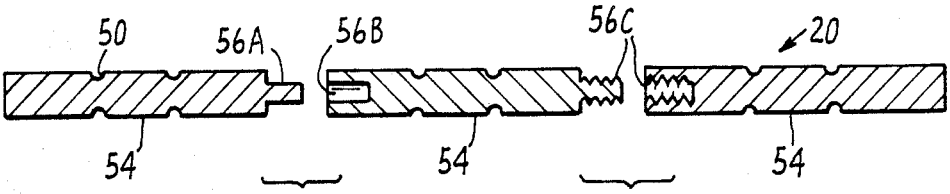
FIG. 7*a* shows a third alternate embodiment of the present invention.
FIG. 7*b* shows a modification to the third alternate embodiment.

FIG. 7 shows a third alternate embodiment of the present invention. The rod 20 of the juggling stick 26 in this embodiment is formed in separable sections 54. This allows the juggling stick 26 to be transported more easily. The sections fit together with male 56*a* and female 56*b* friction fittings or with screw fittings 56*c*. Where friction fittings 56*a* and 56*b* are used it may be preferable to have an elastic cord 57 positioned within the hollow tube of the rod 20 to enhance ability of the juggling stick 26 to remain in one piece during play.

Figure 8:
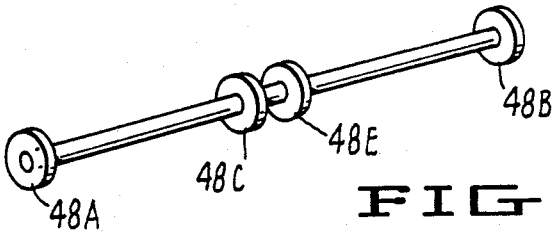
FIG. 8 shows a fourth alternate embodiment of the present invention.

In FIG. 8 the juggling stick has a disc 48A and 48B positioned at each end of the juggling stick similar to the embodiment shown in FIG. 5. However, rather than having a single disc 48C centrally located as in FIG. 5 the embodiment of FIG. 8 has a pair of centrally located discs 48D and 48E symmetrically located about the center of the juggling stick.

Figure 9:
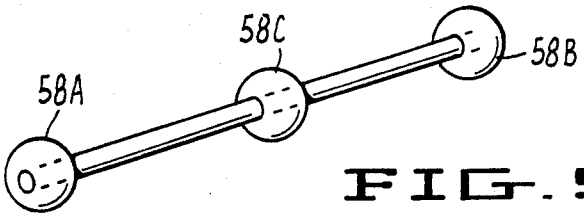
FIG. 9 shows a fifth alternate embodiment of the present invention.

In FIG. 9 the juggling stick has a rubber ball 58A and 58B located at each end and another ball 58C located in the center of the stick. The balls may be mounted onto the juggling stick by forming a hole through a central axis of the ball slightly smaller than the outer diameter of the stick and sliding it over the stick. Additional holding power may be added through the use of glue. The central ball may be substituted with a disc or ferrule pair as shown in reference to the other embodiments. While playing on a paved surface the rubber balls allow the juggling stick to bounce up after a dropping due to a misplay for longer continuous play. As with the other embodiments several balls may be used along the juggling stick shaft. The balls in the center or along the shaft may be of a smaller size than the balls used at the ends of the stick.

It may be desirable for the juggling stick or the spinner stick to have multi colored streamers formed into the ends of the sticks for an enhanced visual effect. The juggling stick may have an outer layer of clear plastic containing colored oil which moves and changes appearance as the stick is used. The juggling stick might also have a phosphorescent or luminescent material so that it glows in the dark for night time playing.

The juggling stick may be made to make sounds during play. Bells or other objects might be placed into the hollow tube of the rod to make noise during play. Holes might be cut at various positions into the hollow rod of the juggling stick and stops placed at differing heights within the rod to create a whistling effect while spinning the rod during play.

An improved juggling stick is disclosed having inwardly facing ferrules positioned at each end and an outwardly facing pair of ferrules positioned along a central rod. The ferrules provide additional striking surfaces for additional ease of play.

What is claimed is:

1. A juggling stick comprising:

a rod having a rod central axis, a surface, a center and two ends wherein the surface of the rod is a striking surface;

first additional striking surfaces positioned at each of the ends wherein each said first additional striking surface is symmetrical about said axis and extends beyond the surface of the rod and of sufficient size to stop the rod traveling along the axis;

a pair of second additional striking surfaces positioned along the rod symmetrically about the center and spaced apart from the first additional striking surfaces wherein each said second additional striking surface is symmetrical about said axis and extends beyond the surface of the rod and of sufficient size to stop the rod traveling along the axis and further wherein each of the pair of second additional striking surfaces is comprised of a second ferrule, each said second ferrule having a second larger end, a second smaller end and a second ferrule central axis, each said second additional striking surface is coupled to the rod so that the second ferrule central axis is coincident with the rod central axis and each second smaller end is closer to the center of the rod than each second larger end.

2. The juggling stick according to claim 1 further comprising a spinner for striking or catching the juggling stick.

3. The juggling stick according to claim 1 wherein each said first additional striking surface is a first ferrule having a first larger end, a first smaller end and a first ferrule central axis, each said first additional striking surface is coupled to the rod, one said first additional striking surface at each end of said rod, so that the first ferrule central axis is coincident with the rod central axis and the first smaller end is closer to the end of the rod than the first larger end.

4. The juggling stick according to claim 1 wherein each of the second additional striking surfaces is a conical frustum.

5. The juggling stick according to claim 1 wherein each first additional striking surface and each second additional striking surface is formed by a cambered ferrule coupled to the rod.

6. The juggling stick according to claim 1 wherein the rod is formed of a plurality of sections capable of being coupled together.

7. The juggling stick according to claim 6 wherein the sections are coupled together by screw threads.

8. The juggling stick according to claim 6 wherein the sections are coupled together by friction fittings.

9. The juggling stick according to claim 8 wherein the sections are held together by an internal elastic cord.

* * * * *